US006529108B2

(12) United States Patent
Ito et al.

(10) Patent No.: US 6,529,108 B2
(45) Date of Patent: Mar. 4, 2003

(54) ELECTRIC APPLIANCE

(75) Inventors: Keiichi Ito, Tokyo (JP); Kiyoyuki Ishikawa, Tokyo (JP); Yasuji Yoshizumi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/874,006

(22) Filed: Jun. 6, 2001

(65) Prior Publication Data

US 2001/0052835 A1 Dec. 20, 2001

(30) Foreign Application Priority Data

Jun. 7, 2000 (JP) ..... 2000-170013

(51) Int. Cl.[7] ..... H01F 27/10; H01F 27/08
(52) U.S. Cl. ..... 336/57; 336/55; 336/58
(58) Field of Search ..... 336/96, 94, 98, 336/55, 57, 58

(56) References Cited

U.S. PATENT DOCUMENTS 4,000,482 A 12/1976 Staub et al. ..... 336/60
4,095,204 A 6/1978 Miyamoto et al. ..... 336/57
4,173,747 A * 11/1979 Grimes et al. ..... 336/60
4,219,791 A * 8/1980 Moore et al. ..... 336/58
4,363,013 A 12/1982 Daikoku et al. ..... 336/60
4,437,082 A 3/1984 Walsh et al. ..... 336/58
4,488,134 A * 12/1984 Pfeiffer ..... 336/58
5,629,661 A * 5/1997 Ooi et al. ..... 336/198
5,825,272 A * 10/1998 Yamada et al. ..... 336/212
5,936,503 A * 8/1999 Holmgren et al. ..... 336/60
6,157,283 A * 12/2000 Tsunemi ..... 336/192
6,348,850 B1 * 2/2002 Kimura et al. ..... 336/200

FOREIGN PATENT DOCUMENTS

JP 8-130123 5/1996 ..... H01F/27/08
JP 0200031186 A * 11/2000

* cited by examiner

*Primary Examiner*—Anh Mai
(74) *Attorney, Agent, or Firm*—Sughrue Mion, PLLC

(57) ABSTRACT

In an electric apparatus, insulating cylinders having different diameters are arranged in a shape of multiple cylinders between the iron core and the low voltage winding, between the low voltage winding and the high voltage winding and on the periphery of the high voltage winding. Spacers are separately arranged between layers of the plurality of insulating cylinders to form a plurality of insulating medium paths. A flow stopping member for stopping the flow of the insulating medium in the insulating medium paths which is made of an insulating material with a low density is arranged at at least one of the upper and lower ends of each of the insulating medium paths.

6 Claims, 6 Drawing Sheets

ELECTRIC APPLIANCE

BACKGROUND OF THE INVENTION

1. Field of the Invention

This invention relates to an electric apparatus filled with an insulating medium of e.g. an insulating oil, an insulating gas, etc. such as a transformer, a reactor, etc.

2. Description of the Related Art

Among electric apparatuses filled with the insulating medium of the insulating oil, a sectional view of an core-form transformer is shown in FIG. 5. A developed view of the portion of an insulating cylinder is shown in FIG. 6. In these figures, reference numeral 1 denotes an iron core with silicon steel laminated; 2 an insulating cylinder arranged on the outer periphery of the iron core 1, which forms a passage A of the insulating medium between itself and a winding; 3 a low voltage winding arranged on the outer periphery of the insulating cylinder 2; and 4*a*, 4*b*, 4*c* intermediate cylinders which are arranged in a shape of multiple cylindrical layers on the outer periphery of the low voltage winding 3 to form insulating barriers. Between the layers, spacers 5*a* and 5*b* are separately arranged to form insulating medium passages C and D. Between the low voltage winding 3 and the inner periphery of the insulating cylinder 4*a*, an insulating medium passage B is formed. Reference numeral 6 denotes a high voltage winding arranged on the outer periphery of the insulating cylinders 4*a*, 4*b* and 4*c*, which forms a passage E for the insulating medium between its inner periphery and the outer periphery of the insulating cylinder 4*c*. Reference numeral 7 denotes an insulating cylinder arranged on the outer periphery of the high voltage winding, which forms an insulating medium passage F between itself and the outer periphery of the high voltage winding 6.

With respect to the low voltage winding 3 and the high voltage winding 6, between the insulating medium passage A or E on the side of the inner periphery and the insulating medium passage B or F on the side of the outer periphery, partitions are arranged for every several disks. In such a configuration, the low voltage winding 3 and the high voltage winding 6 are constructed so that during the running of the apparatus, the insulating medium flows a zigzag form in a direction of an indicated arrow. The insulating medium passages C and D formed between the adjacent ones of the insulating cylinders 4*a*, 4*b* and 4*c* are adapted to communicate upward.

In the transformer constructed described above, the portions of the low voltage winding 3 and the high voltage winding 6 are effectively cooled by the zigzag flow of insulating medium which flows laterally between the respective adjacent disk coils. Since the potential difference between the disk coils of the low voltage winding 3 and high voltage winding 6 is small, the phenomenon of flow charging occurs to a low degree even at a high flow rate. On the other hand, the insulating medium paths C and D formed by the layers of the insulating cylinders 4*a*, 4*b* and 4*c*, which are located between the low voltage winding 3 and high voltage winding 6, are under a high electric field strength. Therefore, when the insulating medium flow through the insulating paths C and D, the surface of each of the insulating cylinders 4*a*, 4*b* and 4*c* is charged with a negative polarity, whereas the insulating medium is charged with a positive polarity. Thus, charges are accumulated on the surface of each of the insulating cylinders 4*a*, 4*b* and 4*c*. This may give rise to partial discharging on the surface, which is a cause of reducing the reliability of insulation.

As described above, the conventional structure having the insulating medium paths C and D between the insulating cylinders 4*a*, 4*b* and 4*c* which form insulating barriers between the low voltage winding 3 and high voltage winding 6 has the following disadvantage. When the insulating medium flows through the insulating medium paths C and C which are under a high electric field strength between the low voltage winding 3 and high voltage winding 6, the phenomenon of flow charging occurs, thereby reducing the reliability of insulation.

SUMMARY OF THE INVENTION

This invention has been accomplished in order to solve the above problem, and intends to provide an electric apparatus which can prevent occurrence of a phenomenon of flow charging in a structure in which insulating medium paths are formed between insulating cylinders which form insulating barriers between an iron core and a low voltage winding, between the low voltage winding and a high voltage winding or on the periphery of the high voltage winding.

To achieve the above object, according to a first aspect of the invention, there is provided an electric apparatus defined in which insulating cylinders having different diameters are arranged in a shape of multiple cylinders between the iron core and the low voltage winding, between the low voltage winding and the high voltage winding and on the periphery of the high voltage winding; spacers are separately arranged between layers of the plurality of insulating cylinders to form a plurality of insulating medium paths; and a flow stopping member for stopping the flow of the insulating medium in the insulating medium paths which is made of an insulating material with a low density is arranged at at least one of the upper and lower ends of each of the insulating medium paths.

According to a second aspect of the invention, in the electric apparatus defined in the first aspect, said flow stopping member is made of a material in the form of a mat of insulating fiber.

According to a third aspect of the invention, in the electric apparatus defined in the third aspect, said flow stopping member configured as described in claim 2 has a volume ratio of insulating fiber of 5–50%.

According to a fourth aspect of the invention, in the electric apparatus, at least one of the upper and lower ends of said insulating medium path is covered with a sheet of said flow stopping member, configured as described in the first aspect, having a volume ratio of insulating fiber of 5–50%.

According to a fifth aspect of the invention, in the electric apparatus, a low voltage winding and a high voltage winding are superposed to arrange a winding in a vertical direction, iron cores are stacked at a center and periphery of the winding, a plurality of layers of insulating barriers are arranged on the outer periphery of the stacked iron cores at the center of the winding and spacers are separately arranged between layers of the plurality of insulating barrier to form a plurality of insulating medium paths in a vertical direction, and a flow stopping member for stopping the flow of the insulating medium in the insulating medium paths which is made of an insulating material with a low density is arranged at at least one of the upper and lower ends of each of the insulating medium paths.

According to a sixth aspect of the invention, in the electric apparatus, a low voltage winding and a high voltage winding are superposed to arrange a winding in a vertical direction, iron cores are stacked at a center and periphery of the winding, a plurality of layers of insulating barriers on the outer periphery of the stacked iron cores at the center of the winding and spacers are separately arranged between layers of the plurality of insulating barrier to form a plurality of insulating medium paths, a flow stopping member for stopping the flow of the insulating medium in the insulating medium paths which is made of an insulating material with a low density is arranged at at least one of the upper and lower ends of each of the insulating medium paths, and a flow suppressing member is arranged in the insulating barriers and each of the iron cores, said flow suppressing member having a length providing a suitable flow rate of the insulating medium.

DETAILED DESCRIPTION OF THE PREFERRED EMBODIMENTS

Now, a description will be given in more detail of preferred embodiments of the invention with reference to the accompanying drawings.

Embodiment 1

Figure 1:
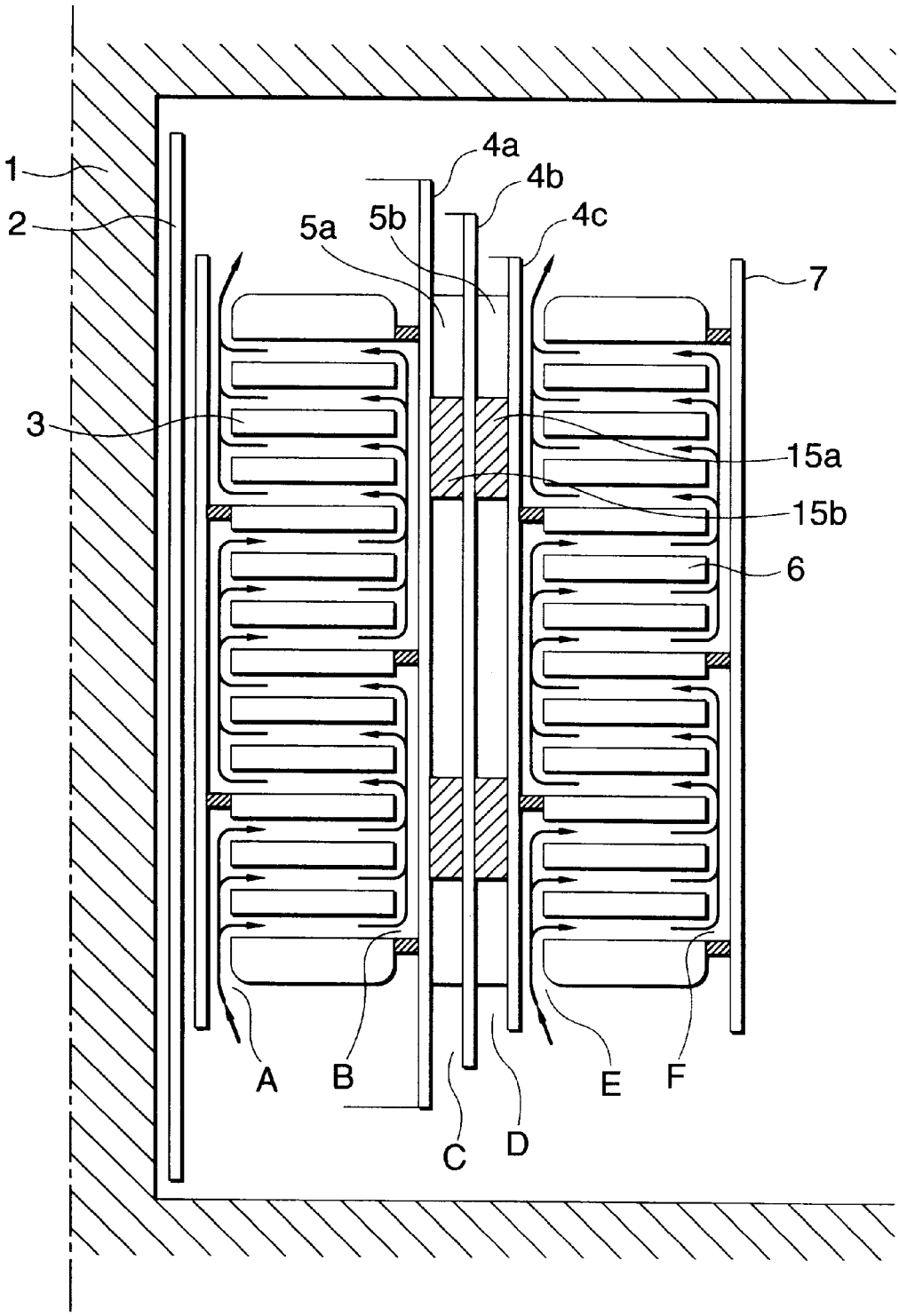
FIG. 1 is a sectional view showing the arrangement of an electric apparatus according to a first embodiment.
Figure 2:
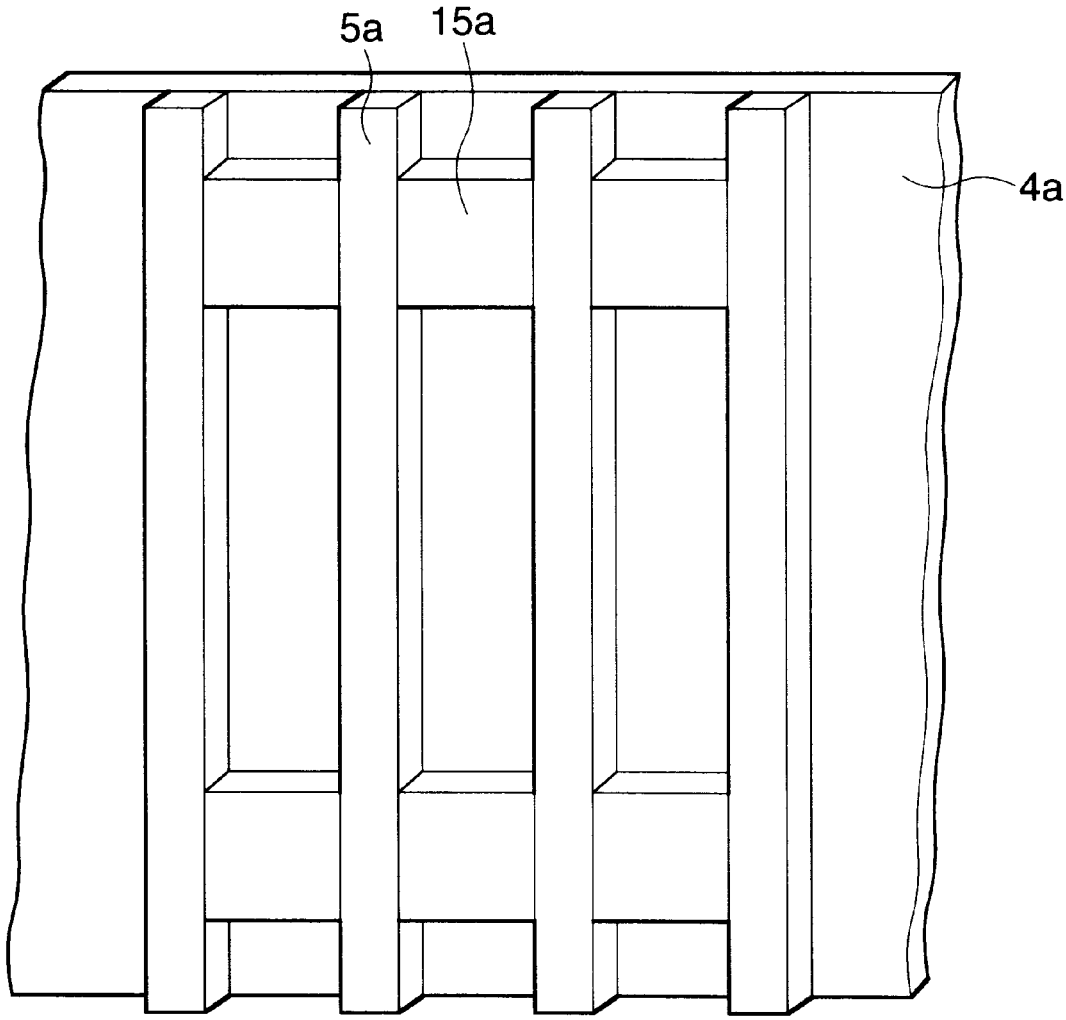
FIG. 2 is a partially developed view of an intermediate insulating cylinder portion in FIG. 1.
Figure 5:
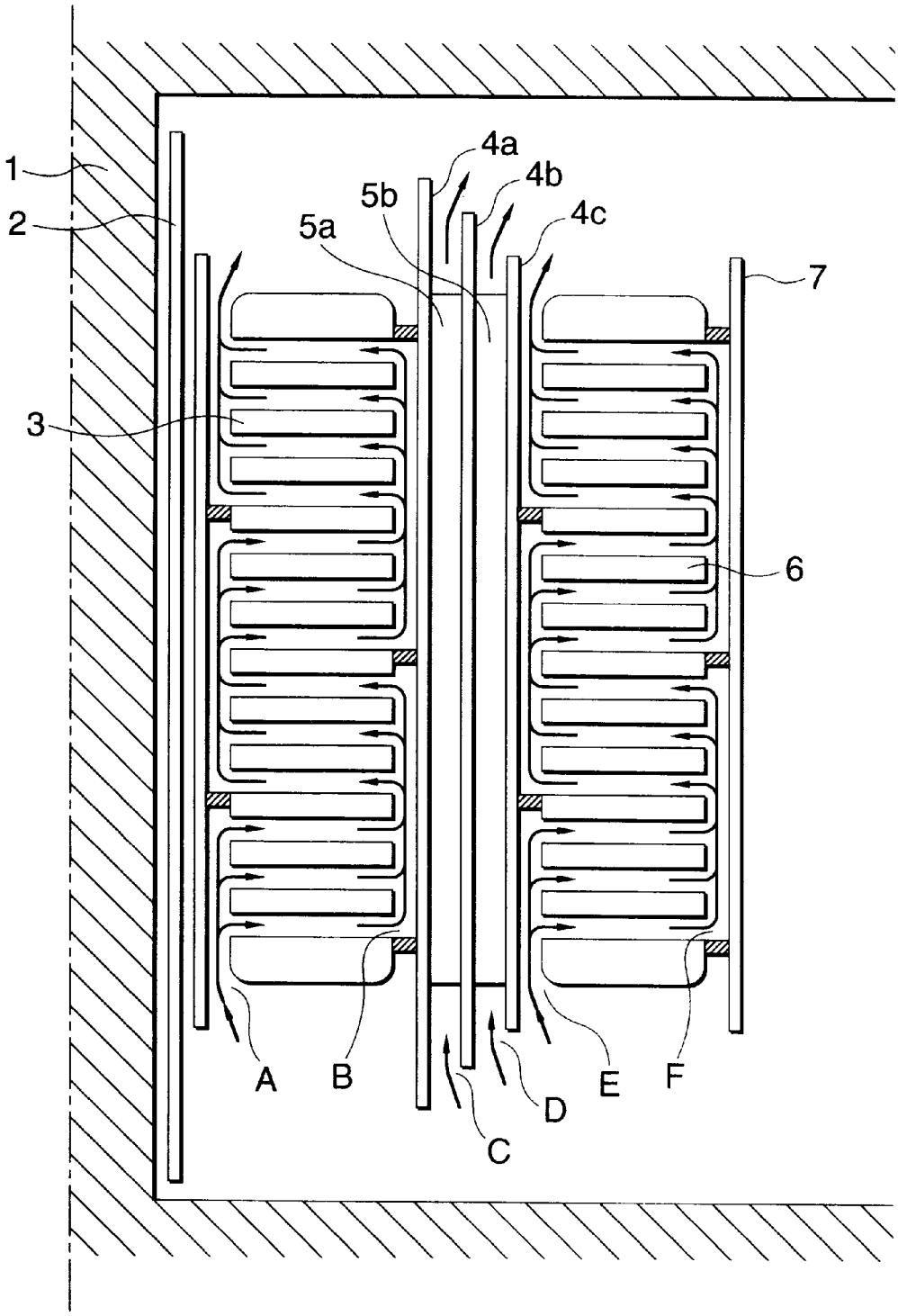
FIG. 5 PRIOR ART
FIG. 5 is a sectional view showing the arrangement of a conventional electric apparatus.
Figure 6:
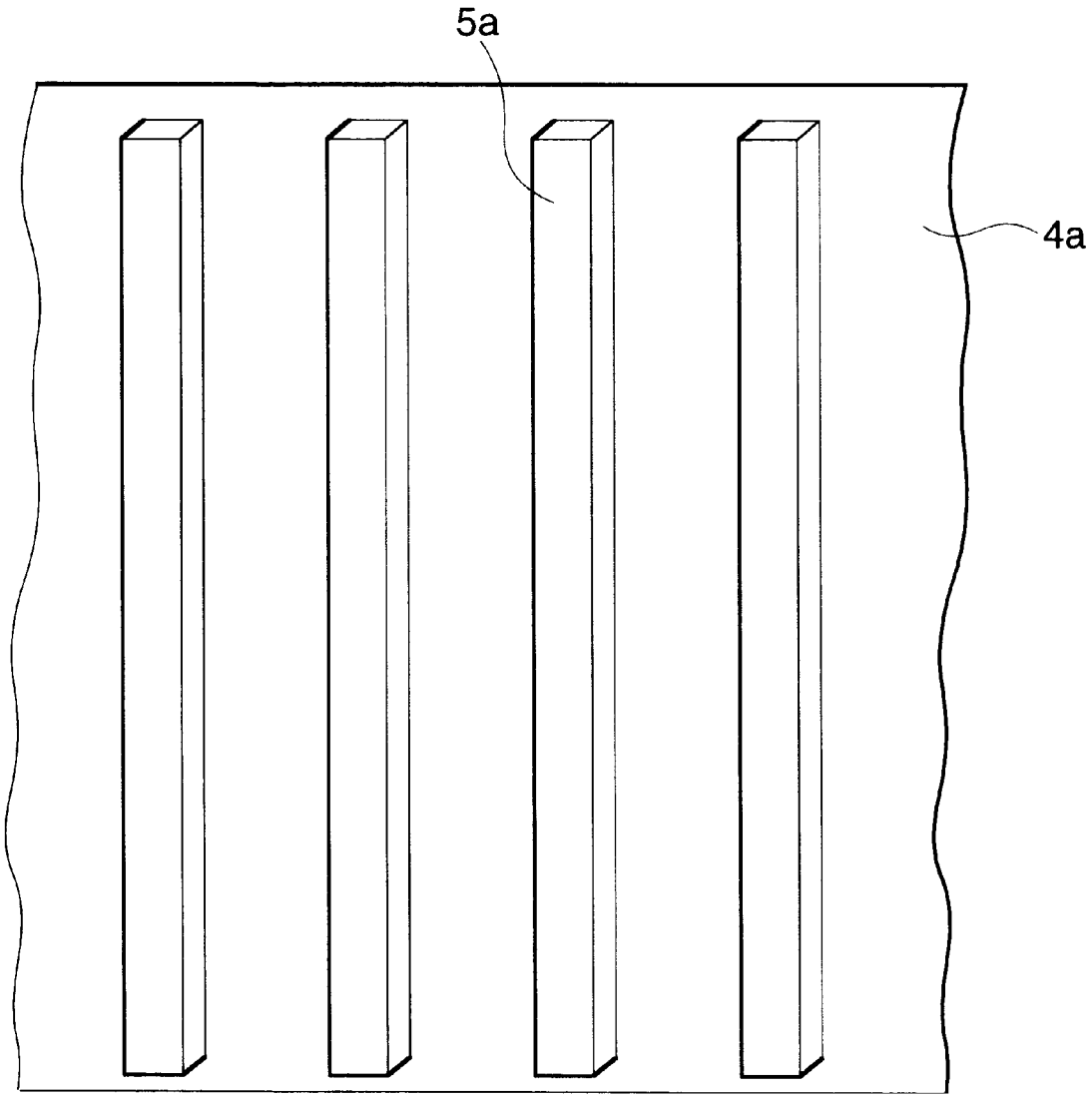
FIG. 6 PRIOR ART
FIG. 6 is a view showing an intermediate insulating cylinder portion in the electric apparatus in FIG. 5.

FIG. 1 shows an arrangement according to the first embodiment. FIG. 2 is a partially developed view of an intermediate cylinder. The arrangement shown in FIG. 1 includes insulating cylinders formed in a shape of multiple cylinders between a low voltage winding and a high voltage winding. In FIG. 1, an iron core 1, an insulating cylinder 2, a low voltage winding 3, intermediate insulating cylinders 4*a*, 4*b*, 4*c*, spacers 5*a*, 5*b*, high voltage winding 6, outer insulating cylinder 7 are formed in the same arrangement as the conventional arrangement shown in FIG. 5. An insulating medium path A on the inner periphery of the low voltage winding 3, an insulating medium path B on the outer periphery thereof, insulating medium paths C and D between the layers of intermediate insulating cylinders, an insulating medium path E on the inner periphery of the high voltage winding 6 and an insulating medium path E on the outer periphery thereof are also formed in the same arrangement as the conventional arrangement shown in FIG. 1.

Reference numeral 15*a* denotes one of oil flow stopping members at the upper position and lower position within the insulating oil path C which is formed between spacers 5*a* which are formed separately between the layers of the insulating cylinders 4*a* and 4*b*. Reference numeral 15*b* denotes one of oil flow stopping members at the upper position and lower position within the insulating oil path C which is formed between spacers 5*b* which are formed separately between the layers of the insulating cylinders 4*b* and 4*c*.

The flow stopping member 15*a* and 15*b* may be made of non-woven cloths in their stacked state which are intertwined with the material or fiber created as a mat of an insulating sheet of paper (which is a main insulating material of the low voltage winding 3 and high voltage winding 6), a polyphenylene sulfide fiber having insulation and heat-resistance equal to those of a pressboard and a fiber material such as polymethypentene. The flow stopping members 15*a* and 15*b* are cut so as to fit the sectional space of insulating medium path C or D. The flow stopping members 15*a* and 15*b* thus cut are arranged at the upper position and low positions of the insulating medium paths C and D. The flow stopping member 15*a*, 15*b* has a density with the volume ratio of 5–50% of fiber material adjusted to the apparent volume.

Thus, the insulating medium paths C and D formed between the layers of the intermediate insulating cylinders 4*a*, 4*b* and 4*c* can be set in a closed state, and the volume ratio of the fiber material of the flow stopping member 15*a*, 15*b* can be 5% or more in a normally operating state where the insulating medium is an insulating oil. Under such a condition, the flow rate in the insulating medium paths C and D can be limited to 1/10 or less. This prevents occurrence of the phenomenon of flow charging due to the flow between the insulating cylinders 4*a*, 4*b* and 4*c*.

The fluid resistance of the fiber material with a low density is proportional to the power of 0.25 of the dynamic viscosity coefficient. Assuming that the running temperature of the transformer is 70° C., the dynamic viscosity coefficient of an insulating oil which is the insulating medium is $3.5\times10^{-6}m^2/s$. Assuming that the running temperature is 70° C. and the pressure is 4 $kg/cm^2$,the dynamic viscosity coefficient of $SF_6$ gas which is a typical insulating gas is $0.6\times10^{-6}m^2/s$. The fluid resistance of the fiber material having the same volume ratio is $(3.5/0.6)^{0.25}=1.6$ times. Thus, the insulating oil has the fluid resistance that is 1.6 times as large as that of the gas. Therefore, as compared with the case of the insulating oil, the volume ratio of the fiber material in which the flow rate of the insulating medium is 1/10 is 8% as in the case where the insulating medium path is filled with the $SF_6$ gas. In this way, since the volume ratio of the fiber material is 5% or higher, the insulating medium can flow at a sufficiently small flow rate. This assures the state where the phenomenon of flow charging does not occur.

After the electric apparatus has been assembled, it is filled with the insulating medium. In this case, if there is a blocked space, air remains in the space so that the space is not filled with the insulating medium. This causes decline of insulation performance of the electric apparatus. However, as long as the volume ratio of the fiber material of the flow stopping member 15*a*, 15*b*, the air can be removed by evacuation when the apparatus is filled with the insulating medium.

In this way, by setting the volume ratio of the fiber material of the flow stopping member 15*a*, 15*b* at 5–50%, the state can be assured where air does not remain when the apparatus is filled with the insulating medium and the phenomenon of flow charging does not occur in the insulating medium paths C and D within the insulating cylinders 4*a*, 4*b* and 4*c* during the running.

The above description relates to the case where a plurality of insulating cylinders are arranged in a shape of multiple insulating cylinders at the intermediate cylinder portion of an core-form transformer and spacers are separately arranged between the layers of the insulating cylinders to form insulating medium paths. However, where the insulating cylinder arranged between the iron core and the low voltage coil or on the outer periphery of the high voltage coil forms the insulating medium path, the same effect can be obtained by arranging the flow stopping member in the insulating medium path as in the above case.

Embodiment 2

Figure 3:
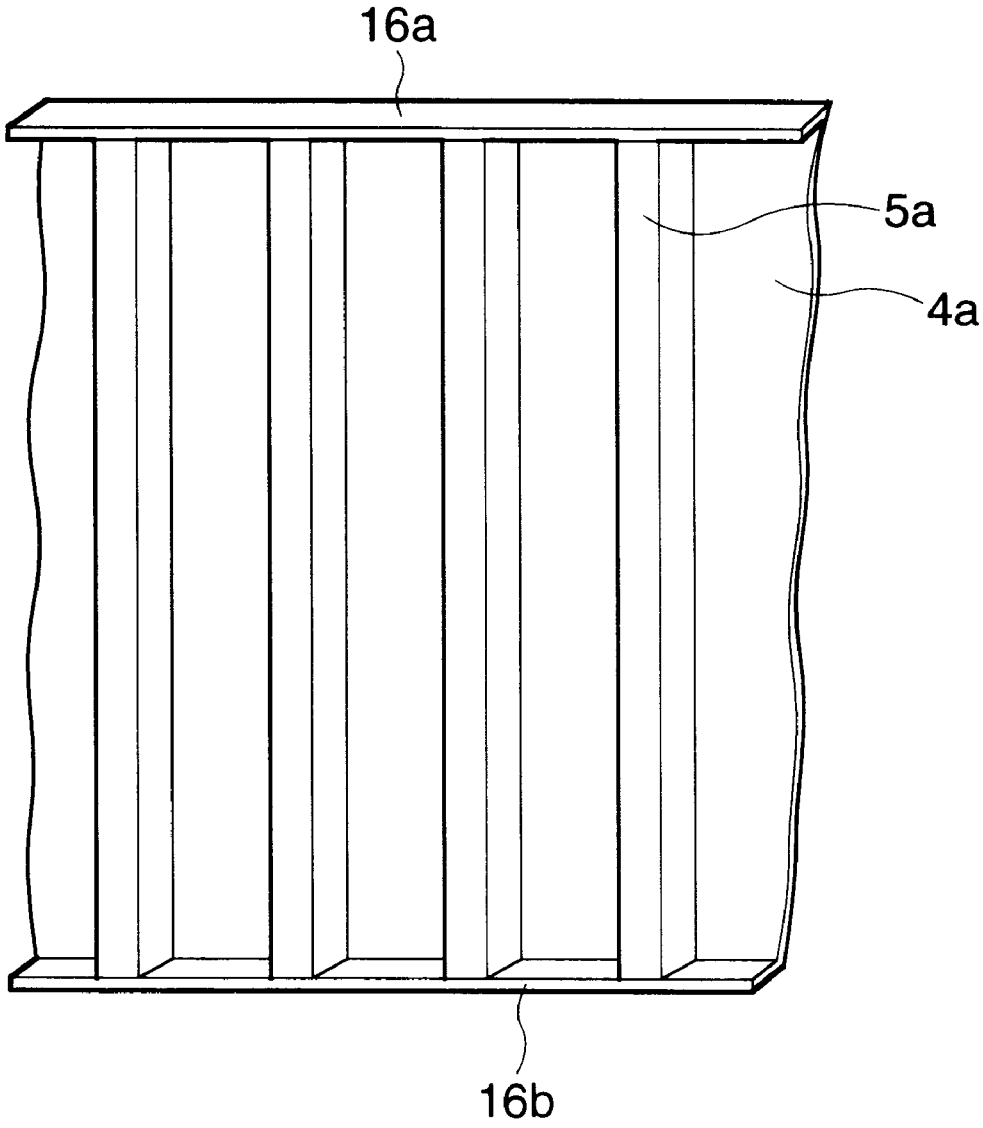
FIG. 3 is a partially developed view of an intermediate insulating cylinder portion according to a second embodiment.

The second embodiment of this invention has a configuration in which the low voltage winding, high voltage winding and intermediate insulating cylinders are arranged in the same manner as in the first embodiment, and the upper and lower ends of the insulating medium path of the insulating cylinder are covered with sheet-like flow stopping members. The developed view of the portion of the intermediate insulating cylinder is shown in FIG. 3. In FIG. 3, reference numeral 16*a*, 16*b* denotes a flow stopping member made as a sheet of fiber material. The flow stopping member 16*a*, 16*b* may be made of a sheet of non-woven cloth or cloth of an insulating material having insulating and heat-resistance equal to those of an insulating sheet, pressboard, etc. which are main insulating materials within the electric apparatus, e.g. polyphenylene sulfide fiber, polymethylpentene fiber, etc. The flow stopping member 16*a* and 16*b* are arranged to stop the upper and lower ends of the insulating medium paths C and D.

By setting the volume ratio of the fiber material of the flow stopping member 16*a*, 16*b* at 5–50% of the apparent volume as in the first embodiment, a configuration can be formed where air does not remain when the apparatus is filled with the insulating medium and the oil flow does not occur in the insulating medium paths C and D during the running. Thus, the state can be assured where the oil flow is stopped and the phenomenon of flow charging does not occur in the insulating cylinder portion.

In this configuration also, where the insulating cylinder arranged between the iron core and the low voltage coil or on the outer periphery of the high voltage coil forms the insulating medium path, the same effect can be obtained by arranging the flow stopping member 16*a* in the insulating medium path as in the above case.

Embodiment 3

Figure 4:
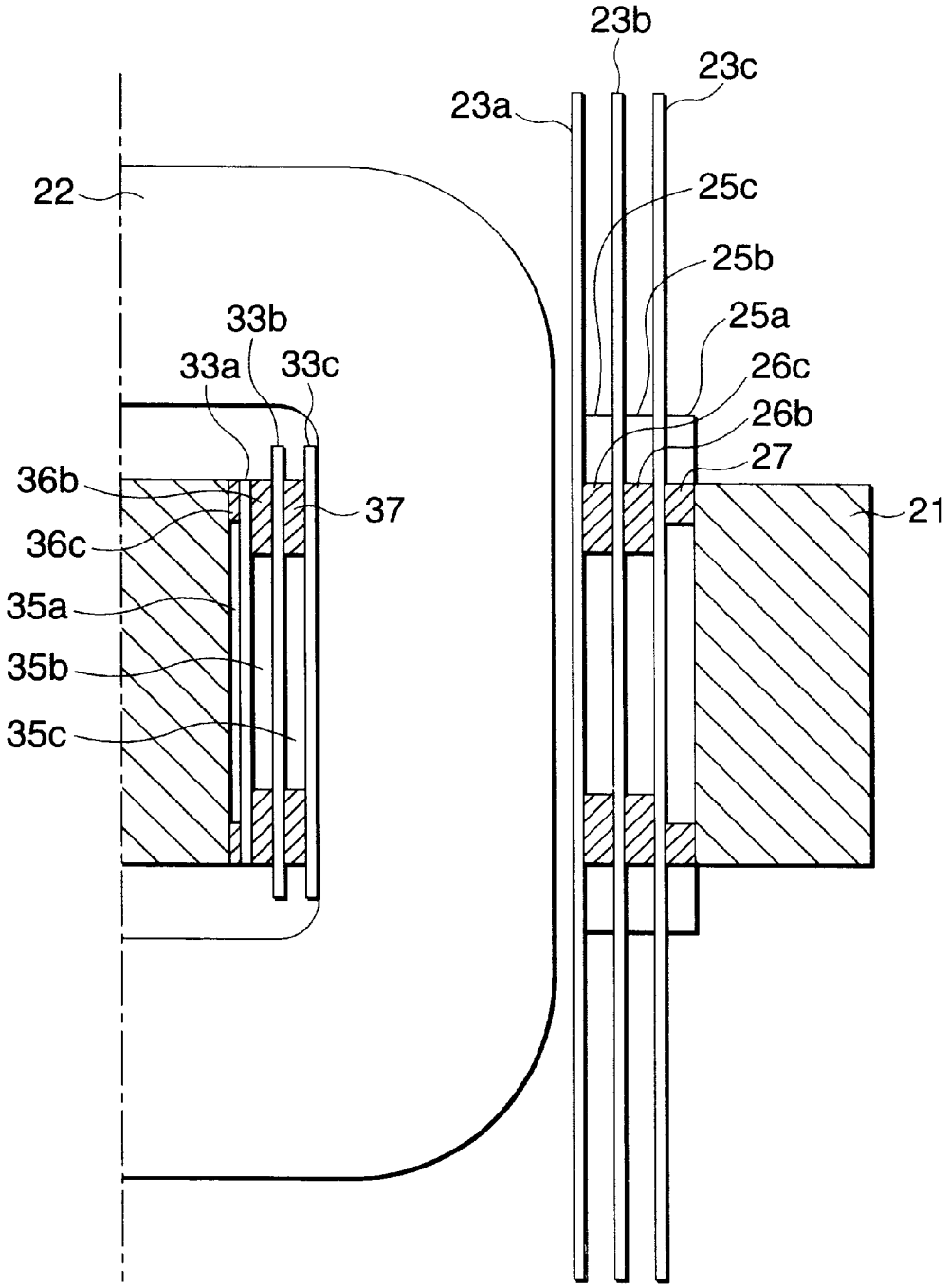
FIG. 4 is a partially sectional view of an insulating cylinder portion in an arrangement in the electric apparatus according to a third embodiment.

The third embodiment of this invention has a configuration of an shell-form transformer in which the flow of the insulating medium is stopped in insulating barriers arranged on the periphery of an iron core and the flow of the insulating medium path between the insulating barriers and the iron core. This configuration is shown in FIG. 4. In FIG. 4, reference numeral 21 denotes a iron core; 22 a winding; 23*a*, 23*b*, 23*c* insulating barriers arranged between the winding 22 and the iron core 21; 25*a*, 25*b*, 25*c* spacers which are separately arranged between the layers of the insulating barriers 23*a*, 23*b* and 23*c* and form insulating medium paths in a vertical direction; and 26*b* and 26*c* oil flow stopping members arranged on the upper and lower ends of the insulating medium paths between the layers of the insulating barriers 23*a*, 23*b* and 23*c*. The flow stopping member 26*a* and 26*b* may be made of non-woven cloths in their stacked state which are intertwined with the material or fiber created as a mat of a polyphenylene sulfide fiber and polymethypentene fiber. The flow stopping members 26*a* and 26*b* have the volume ratio of the fiber material of 5–50%. Reference numeral 27 denotes a flow suppressing member arranged between the iron core 21 and the insulating barrier 23*a*.

Reference numerals 33*a*, 33*b*, 33*c* denote insulating barriers arranged between the winding 22 and the iron core 21; 35*a*, 35*b*, 35*c* spacers which are separately arranged between the layers of the insulating barriers 33*a*, 33*b* and 33*c* and form insulating medium paths in a vertical direction; and 36*b* and 36*c* oil flow stopping members arranged on the upper and lower ends of the insulating medium paths between the layers of the insulating barriers 33*a*, 33*b* and 33*c*. The oil flow stopping member 36*a* and 36*c* are made of the same material as the oil flow stopping members 26*b* and 26*c*. Reference numeral 37 denotes a flow suppressing member arranged between the iron core 21 and the insulating barrier 23*a*.

There is a temperature rise at the iron core 21 due to an iron loss. Therefore, the flow of the insulating medium is required for cooling between the surface of the iron core 21 and the insulating barrier 23*a* and between the iron core 21 and the insulating barrier 33*a*. The cooling is not required between the insulating barriers 23*a* and 23*b*, 23*b* and 23*c*, 33*a* and 33*b*, and 33*b* and 33*c* because no iron loss is present.

When the flow rate of the insulating medium is high, the phenomenon of flow charging occurs so that the reliability of insulating is deteriorated. Therefore, the flow suppressing member 27 or 37 between the iron core 21 and the insulating barrier 23*a* or 33*a* where the cooling is required is adjusted in its volume ratio of the fiber material and length so as to give a fluid resistance which provides a slow flow suitable to cool the iron core 21. The flow stopping members 26*b*, 26*c*, 36*b* and 36*c* between the insulating barrier 23*a* and 23*b*, 23*b* and 23*c*, 33*a* and 33*b*, and 33*b* and 33*c* are adjusted in their volume ratio of the fiber material and length so as to provide a fluid resistance which stops the flow of the insulating medium during the running and prevents air from remaining when the apparatus is filled with the insulating medium.

In such a configuration, the surface of the iron core 21 is cooled while the flow rate of the insulating medium is suppressed, the insulating medium does not flow during the running between the layers of the insulating barriers 23*a*, 23*b* and 23*c* and 33*a*, 33*b* and 33*c*, and air does not remain when the apparatus is filled with the insulating medium. Thus, the electric apparatus with improved reliability can be obtained in which the effects of suitable cooling of the iron core 21 at the portions of the insulating barriers 23*a*, 23*b*, 23*c*, 33*a*, 33*b* and 33*c* and suppressing of the phenomenon of flow charging at the portions of the insulating barriers are in good balance.

The description has been made hitherto on the flow of the insulating medium between the laminated iron core of the shell-form transformer and the face of the winding opposite thereto. However, in other cases also, for example, where gaps for insulating medium paths are formed between the low voltage winding and the high voltage winding, or between the laminated layers of the iron core, an arrangement of stopping or suppressing the insulating medium can be proposed so that air does not remain when the apparatus is filled with the insulating medium and the phenomenon of flow charging during the running does not occur.

In the electric apparatus defined in the first aspect, a flow stopping member for stopping the flow of the insulating medium in the insulating medium paths which is made of an insulating material with a low density is arranged at at least one of the upper and lower ends of each of the insulating medium paths filled with the insulating medium between the layers of the insulating cylinders between the low voltage winding and high voltage winding. Because of this configuration, no air pocket is formed in the insulating cylinders when an oil is injected, and the phenomenon of flow charging is suppressed in the insulating medium paths of the insulating cylinders during the running.

In the electric apparatus defined in the second aspect, said flow stopping member defined in claim 1 is made of a material in the form of a mat of insulating fiber. Therefore, said flow stopping member has necessary elasticity and hence can be easily fit in the insulating medium path.

In the electric apparatus defined in the third aspect, said flow stopping member has a density represented by a volume ratio of insulating fiber of 5–50%. Therefore, when the apparatus is filled with the insulating medium, no air remains and flow of the insulating medium paths of the insulating cylinders during the running is stopped so that the phenomenon of flow charging is suppressed.

In the electric apparatus defined in the fourth aspect, at least one of the upper and lower ends of said insulating medium path is covered with a sheet of said flow stopping member with a low density defined in claim 1. Because of such a configuration, the flow stopping member can be easily fit in assembling of the apparatus.

In the electric apparatus defined in the fifth aspect, a low voltage winding and a high voltage winding are arranged in a vertical direction, iron cores are stacked at a center and periphery of the low voltage winding and high voltage winding, a plurality of layers of insulating barriers are arranged on the outer periphery of the stacked iron cores at the center of the winding and spacers are arranged between layers of the plurality of insulating barrier to form a plurality of insulating medium paths in the vertical direction, and a flow stopping member for stopping the flow of the insulating medium in the insulating medium paths which is made of an insulating material with a low density is arranged at the upper and lower ends of each of the insulating medium stopping paths. Because of such a configuration, the flow of the insulating medium does not occur between the layers of the insulating barriers during the running and no air remains when the apparatus is filled with the insulating medium. For this reason, the phenomenon of flow charging at the insulating barriers is suppressed, thereby improving the reliability of insulation in the electric apparatus.

In the electric apparatus defined in the sixth aspect, a low voltage winding and a high voltage winding are arranged in a vertical direction, iron cores are stacked at a center and periphery of the low voltage winding and high voltage winding, a plurality of layers of insulating barriers are arranged on the outer periphery of the stacked iron cores at the center of the winding and spacers are arranged between layers of the plurality of insulating barrier to form a plurality of insulating medium paths in the vertical direction, a flow stopping member for stopping the flow of the insulating medium in the insulating medium paths which is made of an insulating material with a low density is arranged at the upper and lower end of each of the insulating medium stopping paths, and a flow suppressing member having a length providing a suitable flow rate of the insulating medium is arranged in the insulating medium path between the insulating barriers and each of the iron cores. Because of such a configuration, the flow of the insulating medium does not occur between the layers of the insulating barriers during the running and no air remains when the apparatus is filled with the insulating medium. For this reason, the phenomenon of flow charging at the insulating barriers is suppressed, and the surface of the iron cores is cooled. Thus, the iron cores can be cooled with no phenomenon of flow charging.

What is claimed is:

1. An electric apparatus, comprising:

an iron core;

low and high voltage windings concentrically arranged on an outer periphery of said iron core;

insulating cylinders concentrically arranged between said iron core and said low voltage winding, between said low voltage winding and said high voltage winding and at a periphery of said high voltage winding;

an insulating medium filled internally within said insulating cylinders;

spacers separately arranged between ones of said insulating cylinders to form a plurality of insulating medium paths; and a flow stopping member for stopping the flow of said insulating medium in said insulating medium paths, said flow stopping member being made of an insulating material with a low density interposed between adjacent spacers at least one of the upper and lower ends of each of said insulating medium paths to close the insulating medium paths.

2. The electric apparatus according to claim 1, wherein said flow stopping member is made of a material in the form of a mat of insulating fiber.

3. The electric apparatus according to claim 2, wherein said flow stopping member has a volume ratio of insulating fiber of 5–50%.

4. The electric apparatus according to claim 1, wherein at least one of the upper and lower ends of said insulating medium path is covered with a sheet of said flow stopping member having a volume ratio of insulating fiber of 5–50%.

5. An electric apparatus, comprising:

low and high voltage windings superposed to form a winding in a vertical direction;

a plurality of iron cores stacked at a center and periphery of the winding;

a plurality of insulating barrier layers arranged on an outer periphery of said iron cores stacked at a center of the winding;

a plurality of spacers separately arranged between said plurality of insulating barrier layers to form a plurality of insulating medium paths;

a flow stopping member for stopping the flow of the insulating medium in the insulating medium paths, said flow stopping member being made of an insulating material with a low density and interposed between adjacent spacers to close each of said insulating medium paths.

6. An electric apparatus, comprising:

low and high voltage windings superposed to arrange a winding in a vertical direction;

a plurality of iron cores stacked at a center and periphery of the winding;

a plurality of insulating barrier layers on the outer periphery of said iron cores stacked at the center of the winding;

a plurality of spacers separately arranged between said plurality of insulating barrier layers to form a plurality of insulating medium paths;

a flow stopping member for stopping the flow of the insulating medium in the insulating medium paths, said flow stopping member made of an insulating material with a low density and arranged in each of said insulating medium stopping paths; and a flow suppressing member arranged in said insulating barrier layers and each of said iron cores, said flow suppressing member having a length providing a suitable flow rate of the insulating medium.

* * * * *